US006688276B2

(12) United States Patent
Baptista et al.

(10) Patent No.: US 6,688,276 B2
(45) Date of Patent: Feb. 10, 2004

(54) INTERNAL COMBUSTION ENGINE OF CIRCULAR IMPULSION

(76) Inventors: Fernando Augusto Baptista, Rua Pádua Correia, 30, 4400-238 Vila Nova de Gaia (PT); João Manuel Pereira Dias Baptista, Rua Porfírio Gomes Moreira, 28, 4740 Esposende (PT)

( * ) Notice: Subject to any disclaimer, the term of this patent is extended or adjusted under 35 U.S.C. 154(b) by 0 days.

(21) Appl. No.: 10/130,266

(22) PCT Filed: Apr. 6, 2001

(86) PCT No.: PCT/PT01/00005

§ 371 (c)(1),
(2), (4) Date: May 24, 2002

(87) PCT Pub. No.: WO01/86119

PCT Pub. Date: Nov. 15, 2001

(65) Prior Publication Data

US 2002/0170530 A1 Nov. 21, 2002

(30) Foreign Application Priority Data

May 10, 2000 (PT) ..... 102460

(51) Int. Cl.[7] ..... F02B 53/04

(52) U.S. Cl. ..... 123/226; 123/227; 123/43 C; 123/204; 418/262; 418/263

(58) Field of Search ..... 123/226, 227, 123/229, 241, 43 C; 418/260–263, 122

(56) References Cited

U.S. PATENT DOCUMENTS

| | | | | | |
|---|---|---|---|---|---|
| 1,349,353 | A | * | 8/1920 | Wilber, Jr. | 123/227 |
| 1,715,490 | A | * | 6/1929 | Ballerstedt | 418/263 |
| 2,283,433 | A | * | 5/1942 | Gross | 418/262 |
| 3,306,269 | A | * | 2/1967 | Dimmock, Jr. | 123/227 |
| 3,938,478 | A | | 2/1976 | Piper | 123/229 |
| 4,038,948 | A | * | 8/1977 | Blackwood | 123/43 C |
| 4,389,173 | A | | 6/1983 | Kite | 418/260 |
| 5,709,188 | A | * | 1/1998 | Al-Qutub | 123/204 |

FOREIGN PATENT DOCUMENTS

| | | | | | |
|---|---|---|---|---|---|
| GB | 1 432 971 | | | 4/1976 | F01C/1/04 |
| JP | 59028086 | A | * | 2/1984 | F04C/18/39 |
| SU | 1017803 | A | * | 5/1983 | F02B/53/00 |
| WO | WO 95/08699 | A | * | 3/1995 | F02B/53/08 |

* cited by examiner

*Primary Examiner*—Thomas Denion
*Assistant Examiner*—Thai-Ba Trieu
(74) *Attorney, Agent, or Firm*—Hoffman Wasson & Gitler PC

(57) ABSTRACT

The engine includes a cylindrical rotor, set up in the interior of a stator, limited by two flat surfaces forming a first chamber to provided the admission phase and the compression phase and another chamber to provided the expansion phase (D1) and the exhaust phase. The chambers are separated by two section. The peripheral interior surface of the stator is adjusted to the rotor periphery and its extension corresponds to the gap between two pistons.

5 Claims, 2 Drawing Sheets

INTERNAL COMBUSTION ENGINE OF CIRCULAR IMPULSION

BACKGROUND OF THE INVENTION

1. Field of the Invention

The invention refers to a new type of internal combustion engine, in which the actions and the forces corresponding to the phases of admission, compression, combustion, expansion and expelling are developed and act according to a circular movement and simultaneously during the same rotation period.

2. Description of the Related Art

In the previous technique, several types of this engines were already presented differing mainly in terms of shape, drawing and disposition of the chambers; in terms of shape, drawing and way of intervention of the rotor, and in terms of number, shape, drawing and way of the insertion and acting of the respective pistons.

Several difficulties have prevented the application and the practical use of the type of engines, the main difficulties are: a difficult conjugation of the spaces inherent to the pistons movement along the chambers; too much inertia and a difficult pistons movement towards the chambers and their support in the rotor; the energy wastes as a consequence of the transfer of the gaseous mass from the compression zone to the combustion zone and from the latter to the expansion zone; lack of a sufficient and practical cooling in the internal part of the engines.

BRIEF SUMMARY OF THE INVENTION

The purposes of the present invention are to overcome the difficulties mentioned above in the following way:

- to draw the engine chambers, with cylindrical peripheries of the greater relative extension and with different curvatures terminals more accentuated in the beginnings of the admission and the expansion;
- to make a new type of piston, and to be inserted in the rotor, so that its support direction may be very near the tangential to the rotor, being obtained a higher efficiency of the impulse applied to the piston, in its transformation into the rotor rotation, and to obtain an easy axial movement of the piston by means of its rotation central to one support, decreasing the wastes derived from inertia and attrition;
- to perform the insertion of the combustion chambers in the rotor periphery, between two pistons in a consecutive position, being obtained the compression, the combustion and the expansion of the gaseous mass in a continuous way avoiding inherent wastes in the transfer of the said gaseous mass;
- to be obtained an easy and sufficient cooling of the engine interior, resulting from the new piston drawing and its insertion way in the rotor, being created chambers on each side of the support base of the piston, which pump the air for cooling of the engine interior due to the alternative movement of the said piston base;
- the said cooling chambers to have connection with the channel of the air supply of the engine and to be used the caught heat and transported by the said air, being obtained a higher energetic efficiency.

The rotor and the pistons are in an average position of the rotor movement, showing the simultaneous performance of the four strokes de work of the engine.

Figure 1:
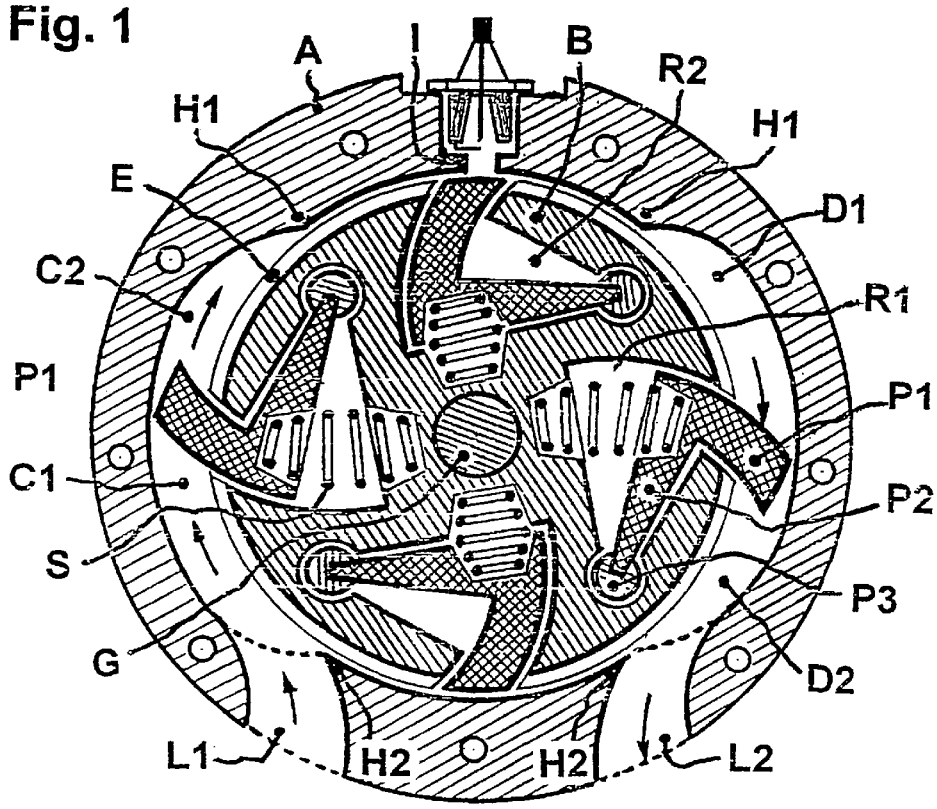
FIG. 1 shows, in radial section, the stator (A), the rotor (B), the admission (C1) and the compression (C2) chambers, the combustion chamber (E), the expansion (D1) and the exhaustion (D2) chambers, the piston body (P1), the piston base (P2), the piston support (P3), the piston chambers (R1) and (R2), the springs (S), the admission aperture (L1) and the exhaustion aperture (L2).
Figure 2:
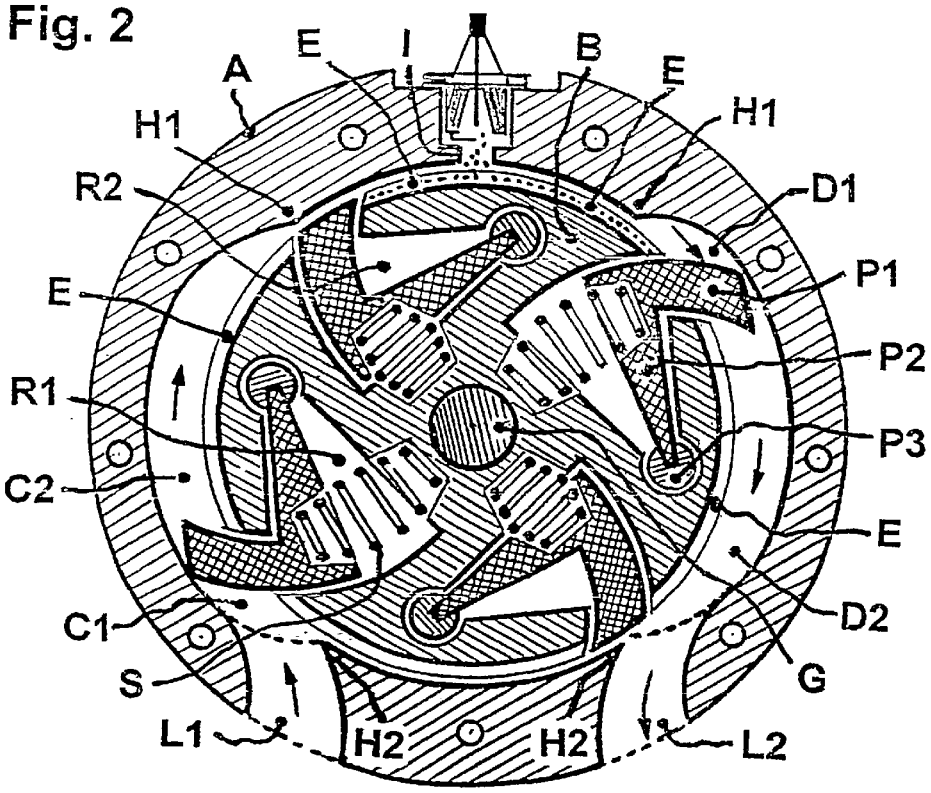
Figure 3:
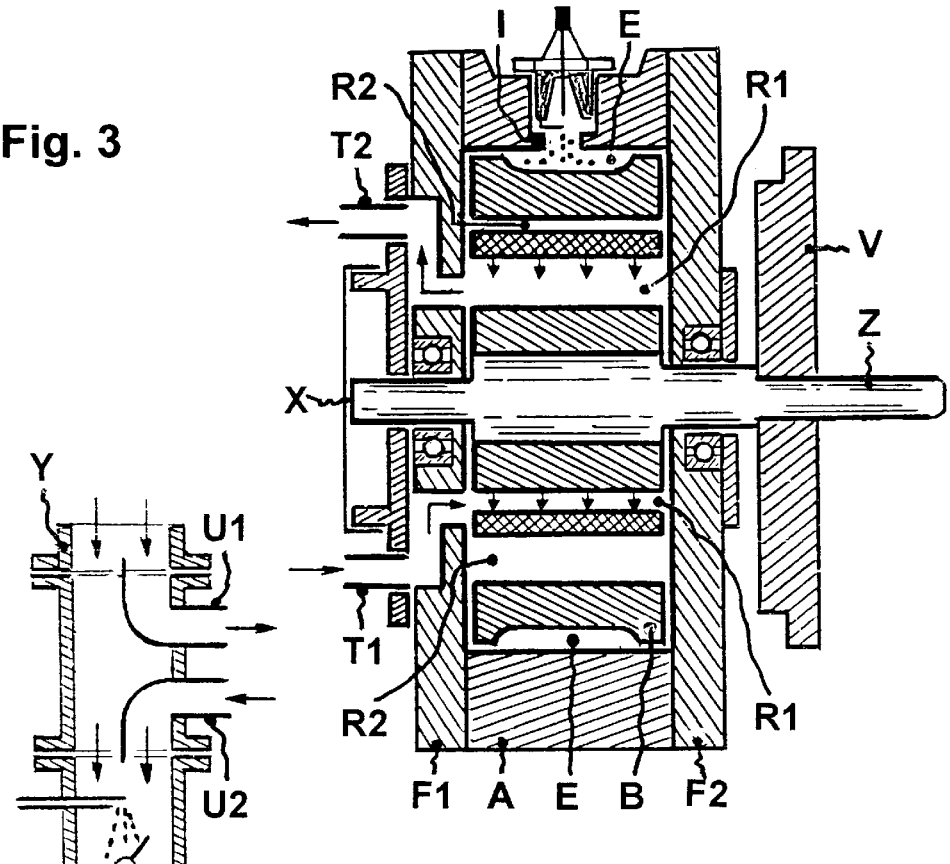

FIG. 2 shows the rotor and the pistons in the position in which the admission (C1) and the compression (C2) start, the combustion (E) is performed, and the expansion (D1) and exhaust (D2) start FIG. 3 shows in axial section, the stator (A), the rotor (B), the flat faces (F1) and (F2) of the engine, the side face of the combustion chamber (E); in the upper position, the retraction of the piston chamber (R2) and the beginning of the emptying of the cooling air contained in the piston chamber (R1) and its transport to the exit terminal (T2); in the lower position, the beginning of the admission of the cool air through the terminal (T1) and its transport to the filling up of the piston chamber (R1); the identical means are fixed for the chamber cooling (R2).

FIG. 3 still shows the engine shaft (Z), the flying-wheel (V) for the clutch position and with the toothed periphery for the connection with electrical starter engine, and the eccentric (X) of the ignition switch.

Figure 4:
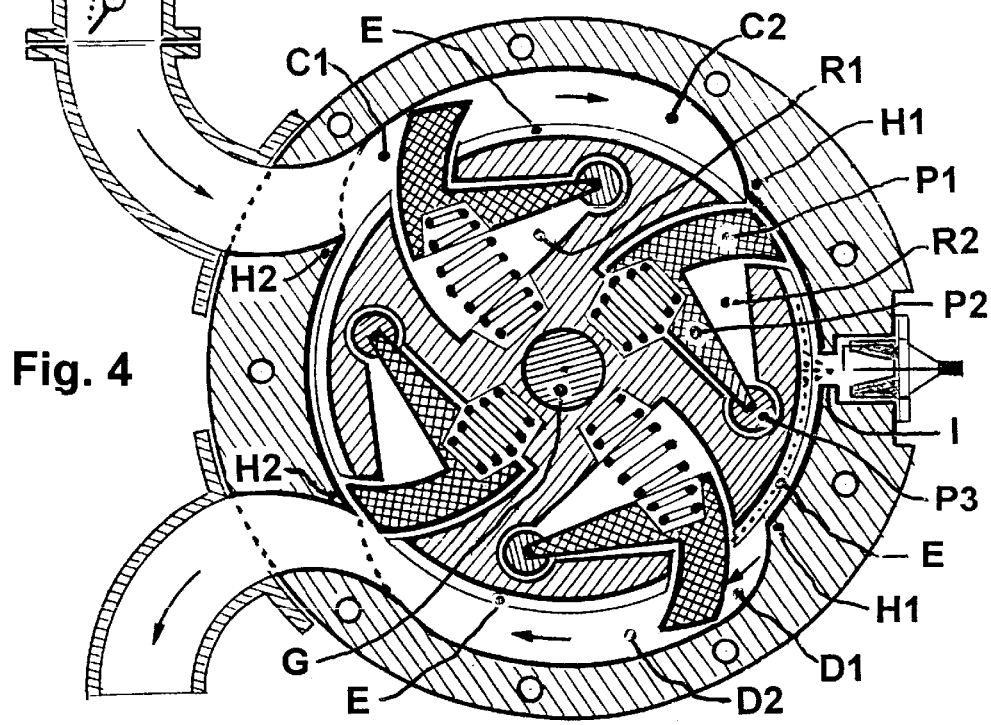

FIG. 4 shows the relative position of the pistons, identical to FIG. 2; its shows sections (Y), of the channel of the supply air of the engine, after the filter and before the fuel supply, where the exit terminals (U1) of the cool air are inserted, connected with terminal of the engine body (T1) for the entrance of the said cool air used in the cooling of the engine interior, and the terminal (U2) for receiving the hot air, after being used in the said cooling.

DESCRIPTION OF THE PREFERRED EMBODIMENT

The engine comprising (FIGS. 1 to 4), a cylindrical rotor (B) set up in the interior of a stator (A), centered with a shaft (G), externally limited by two flat surfaces (F1) and F2), (FIG. 3), being formed one chamber for the achievement of the admission phase (C1) and compression phase (C2), and one chamber for the achievement of the expansion phase (D1) and the exhaust phase (D2).

The chambers possess a cylindrical peripheral surface and the terminal surfaces have a different curvature radius, being smaller those which are contiguous to the admission aperture (L1) and the expansion beginning (D1).

The said chambers are separated by two sections, in an opposite position (H1) and (H2), in which the interior surface of the stator is adjusted to the peripheral surface of the rotor, and in which its extension corresponds to the interval between two consecutive pistons.

The section (H1) corresponds to the position of the ignition and combustion of the gaseous mass, in the combustion chamber (E) positioned in the rotor periphery to the said interval between two consecutive pistons; section (H2) corresponds to the limits of the admission (L1) and exhaust (L2), apertures.

The rotor (B) preferably has got four pistons symmetrically put at intervals:

Each piston is inserted in a corresponding chamber, in order to turn in the direction of the interior periphery of the stator.

The piston is formed by a first part, the piston body (P1), of an extended circular section and centered with a support cylindrical bolt (P3).

The piston is formed by a second part, the support base (P2), connected with the first one, possessing flat faces, convergent and extended in a direction near to the tangential, and which is supported by its a slot inserted in the said cylindrical bolt (P3).

The piston has got an angular and alternate rotation, centred in the said bolt (P3) so that the circular and axial surfaces of the said body (P1) may slide through the contiguous surfaces of the corresponding rotor chamber, and its exterior profile face may slide in the stator internal surface.

Each piston possesses a set of springs (S) positioned between the support base (P2) of the piston and the contiguous side of the rotor chamber, intended to keep the contact between the body profile of the piston and the stator internal periphery.

Some important advantages derive from the way the piston is constructed, and of its support (P3), having a direction and a position which are very near the tangential direction of the rotor:

It allows that the great impulsion forces applied to the piston body (P1), mainly in the expansion phase, are supported by cylindrical bolts (P3), according to a very near direction of the said tangential direction of the rotor.

Being the direction of the said forces very near the tangential it allows getting a great efficiency in the transformation of the impulsion forces of the pistons into the impulsion force of the rotor.

The movement of the piston body so that its profile may follow the interior periphery of stator is circular and centered in the said bolt (P3), being obtained a great reduction of the opposing forces, derived from inertia and attrition.

In the rotor interior chambers (R1) and (R2) are formed on each side of the support base of the piston (P2); these chambers vary of the volume due to the alternate movement of the said support base of the piston, being used for moving the cooling air of the engine interior (FIG. 3) and (FIG. 4).

In the engine cover small channels are provided which lead the cooling air from orifices which go through the said cover, in convenient connection points with the chambers (R1) and (R2), to exterior terminals (T1) and (T2).

One terminal (T1) is intended to the admission of cool air and the other terminal (T2) is intended to the exit of the hot air, after the engine refrigeration.

The said terminals (T1) and (T2) are connected with corresponding terminals (U1) and (U2), inserted in the channel (Y) of the supply air of the engine. In the interior of the said channel disposition with curved elements are performed which make easier the exit of the cool air in the terminal direction (U1) and the entrance of the hot air through the terminal (U2).

The good use of the said refrigeration air for the engine supply allows to get remarkable fuel economy.

In the extremity of the engine shaft (Z), a flying wheel (V) is fixed for clutch adaptation and with a toothed periphery for connection with electrical starter engine. Due to the great regularity of the impulsion forces on the rotor, the weight and the inertia of the flying wheel may be very reduced. The extreme opposite of the shaft is an eccentric (X) which acts upon the electrical ignition switch.

In the engine functioning, each piston simultaneously performs two phases, in its way in each chamber, and so it performs the four phases in each period of the engine rotation.

Through aperture (L1) of the first chamber, the piston performs the admission phase through anterior face and the compression phase through the posterior face. In this phase the extension used by the chamber is progressively reduced and the gaseous mass is totally confined in the combustion chamber (E), when this completely limited by the interior periphery of the stator (H1) and the next piston is slightly advanced in the chamber (D1); a small orifice (I) establishes the communication between the combustion chamber (E) and a small chamber which lodges a spark plug, which causes the combustion of the gaseous mass and its expansion; the force derived from the said expansion acts on the whole useful area of the piston face (P1), being obtained the maximum efficiency in the application of the expansion force; at the same time it is obtained the expulsion of the gases, derived from the prior combustion and expansion, through aperture (L2), which, being largely dimensioned, does not practically cause very obstruction.

This way of the engine functioning also permits to be obtained remarkable fuel economy.

The simplification of the operation functions of the engine, avoiding great attrition and inertia forces, permits the application of lighter construction elements which may obtain the simplification of the engine construction and a considerable reduction of its weight in relation to its power.

What is claimed is:

1. A rotary internal combustion engine, comprising a cylindrical rotor having pistons therein, the rotor being located in the interior of a stator, the stator being limited externally by two flat side surfaces and a curved peripheral surface, there being formed in the peripheral surface of the stator one first chamber to provide an admission phase and a compression phase and a second chamber to provide an expansion phase and an exhaust phase, wherein:

the peripheral surfaces of said chambers are circular and end with surfaces having a different radius of curvature, being smaller than the radius of curvature of the contiguous surfaces of the admission phase and the expansion phase;

the chambers being separated by first and second separation sections, in which the peripheral interior surface of the stator is matched to the peripheral surface of the rotor, whereby the length of the separation sections corresponds to the peripheral gap between two consecutive pistons;

the rotor pistons, preferably four, are each inserted in a corresponding rotor chamber so that the rotor piston can pivot alternately in the direction of the stator chambers;

each piston being formed by a first part, a piston body, which turns in the direction of the interior peripheral surface of the stator and which has a side face which slides along the interior peripheral surface; and a second part, a piston base, connected radially with the first part at one extremity, and having the other extremity supported in a longitudinal slot of a circular support bolt;

rotor chambers are formed in the rotor interior on each side of the corresponding piston base so that the rotor chambers vary in volume due to the alternate movement of the piston base and thus pump air for cooling the engine interior; and air from the supply channel of the engine being used for cooling of the engine interior and the same air then being returned to the supply channel for use in the engine after being heated during said engine cooling, there being appropriate passages which connect the rotor chambers to the supply channel through first and second junctions.

2. The engine according to claim 1, wherein the first separation section of the stator chambers corresponds to the ignition position of the gaseous mass in the combustion chambers on the rotor periphery between two consecutive pistons, and the second separation section corresponds to the limits of admission and exhaust apertures.

3. The engine according to claim 1, wherein each said piston base possesses flat faces which converge in the direction of the support bolt.

4. The engine according to claim 1, wherein small channels are provided in the stator side surfaces which lead the cooling air of the engine from small openings that cross the surfaces in convenient points for connection with the rotor chambers to exterior terminals; one of the exterior terminals allowing the admission of the cool air and the other allowing the exit of the hot air after having cooled the engine.

5. The engine according to claim 4, wherein the terminals are connected to the first and second junctions in the supply channel, the first and second junctions being formed as curved elements provided in the interior of the supply channel, to assist flow of the cool air into the first junction and out of the second junction.

* * * * *